US009661411B1

(12) United States Patent
Han et al.

(10) Patent No.: US 9,661,411 B1
(45) Date of Patent: May 23, 2017

(54) INTEGRATED MEMS MICROPHONE AND VIBRATION SENSOR

(71) Applicant: Apple Inc., Cupertino, CA (US)

(72) Inventors: Caleb C. Han, Sunnyvale, CA (US); Jun Zhai, Cupertino, CA (US); Tongbi T. Jiang, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/005,908

(22) Filed: Jan. 25, 2016

Related U.S. Application Data

(60) Provisional application No. 62/261,750, filed on Dec. 1, 2015.

(51) Int. Cl.

| | |
|---|---|
| ***H04R 1/14*** | (2006.01) |
| ***H04R 19/00*** | (2006.01) |
| ***H04R 19/04*** | (2006.01) |
| ***H04R 1/10*** | (2006.01) |
| ***H04R 31/00*** | (2006.01) |

(52) U.S. Cl.
CPC ..... *H04R 1/14* (2013.01); *H04R 1/1041* (2013.01); *H04R 19/005* (2013.01); *H04R 19/04* (2013.01); *H04R 31/006* (2013.01); *H04R 2201/107* (2013.01)

(58) Field of Classification Search
CPC ..... H04R 1/14; H04R 1/1041; H04R 19/005; H04R 19/04; H04R 31/006; H04R 2201/107
See application file for complete search history.

(56) References Cited

U.S. PATENT DOCUMENTS

| | | | | |
|---|---|---|---|---|
| 5,874,675 | A | 2/1999 | Edmans et al. | |
| 7,600,429 | B2 | 10/2009 | Wang | |
| 7,649,305 | B2 | 1/2010 | Priya et al. | |
| 8,391,529 | B2 | 3/2013 | Herman | |
| 8,588,435 | B2 | 11/2013 | Bominaar-Silkens et al. | |
| 8,653,634 | B2 | 2/2014 | Chiu et al. | |
| 8,656,778 | B2 * | 2/2014 | Guo | G01P 15/125 73/514.32 |
| 8,794,065 | B1 | 8/2014 | Yang | |
| 8,997,564 | B2 | 4/2015 | Nasiri et al. | |
| 2007/0062282 | A1 * | 3/2007 | Akashi | G01C 19/5719 73/504.12 |
| 2008/0205668 | A1 | 8/2008 | Torii et al. | |
| 2009/0287485 | A1 | 11/2009 | Glebe | |
| 2009/0296951 | A1 * | 12/2009 | De Haan | H04R 1/10 381/74 |
| 2013/0192364 | A1 * | 8/2013 | Acar | G01C 19/5733 73/504.12 |
| 2014/0072148 | A1 | 3/2014 | Smith et al. | |
| 2014/0093091 | A1 | 4/2014 | Dusan et al. | |
| 2014/0093093 | A1 | 4/2014 | Dusan et al. | |
| 2014/0270231 | A1 | 9/2014 | Dusan et al. | |

* cited by examiner

*Primary Examiner* — Brenda Bernardi
(74) *Attorney, Agent, or Firm* — Blakely, Sokoloff, Taylor & Zafman LLP

(57) ABSTRACT

MEMS microphone and vibration sensor dies and packages are described. In an embodiment, a MEMS microphone and vibration sensor die includes a die substrate, a MEMS microphone on the die substrate and a MEMS vibration sensor on the die substrate. The MEMS vibration sensor may include a plurality of beams with different proof masses corresponding to different resonant frequencies, wherein the different proof masses comprise a same material as the die substrate.

20 Claims, 11 Drawing Sheets

INTEGRATED MEMS MICROPHONE AND VIBRATION SENSOR

CROSS-REFERENCE TO RELATED APPLICATION

This application claims the benefit of the earlier filing date of U.S. Provisional Patent Application No. 62/261,750, filed Dec. 1, 2015 and incorporated herein by reference.

FIELD

Embodiments described herein relate to a micro-electro-mechanical systems (MEMS) microphone and vibration sensor die formed by MEMS processing steps. More specifically, an integrated MEMS microphone and vibration sensor die that can be used to eliminate unwanted sounds and improve vocal sound detection.

BACKGROUND

Contemporary electronics and portable electronic devices commonly include one or more microphones, and as more features are being introduced, more than one microphone may be included for complex audio processing. One such microphone is the electret condenser microphone (ECM) that includes a capacitive sensing plate and a field effect transistor (FET) amplifier. The FET amplifier can be in an integrated circuit (IC) die located within the microphone package enclosure. The IC die may additionally include an analog to digital converter (ADC) for digital microphone applications.

More recently, micro-electro-mechanical systems (MEMS) microphones have been introduced. Similar to an ECM, a MEMS microphone may feature capacitive sensing with a fixed diaphragm. In addition to an amplifier and ADC, a MEMS IC die may include a charge pump to bias to diaphragm.

ECM and MEMS microphone packages include a sound inlet, or hole, adjacent the capacitive sensing plate or membrane for operation, e.g., to allow the passage of sound waves that are external for the package. A particle filter may be provided in order to mitigate the impact of particles on operation. Sound waves entering through the sound inlet exert a pressure on the capacitive sensing plate or membrane, and an electrical signal representing the change a capacitance is generated.

Recently MEMS microphones have been adapted for use in mobile electronic devices such as smartphones, music players and mobile computers. In portable devices, however, the interference from unwanted environmental sounds (e.g., noise) becomes more problematic for audio sensing. Many of the technologies developed for eliminating or cancelling unwanted sounds use conventional microphones that detect sound through air. Such systems, however, may face challenges when it comes to distinguishing between desirable sounds falling within frequency ranges typical of unwanted sounds (e.g., low frequency ranges).

SUMMARY

Generally, the invention relates to a MEMS microphone and MEMS vibration sensor that are integrated as one, at the die or in some cases, the package, level. Representatively, in one embodiment, the MEMS microphone and MEMS vibration sensor are formed from a single die substrate using MEMS processing techniques. The MEMS microphone can be use to detect vocal sounds through the air while the MEMS vibration sensor can be used to detect vocal sounds based on contact with a vibrating surface of the user (e.g., portion of the neck near the user's vocal chords), in other words, mechanical vibrations. In this aspect, the MEMS vibration sensor may be used in conjunction with, or instead of, the MEMS microphone to maximize the vibration sensitivity and acoustic signal output of the device. Representatively, in one embodiment, the MEMS vibration sensor may be used to detect low frequency sounds using mechanical vibrations of the skin near the vocal cord of a user (e.g., the neck). The MEMS microphone may be designed to use air pressure changes in the air to detect vocal sounds that are outside of (e.g., higher), or overlapping with, the frequency range detectable by the vibration sensor. In this aspect, when vocal sound detection is desired yet a level of unwanted environmental sound is high (e.g., the user is in a subway, airport, traffic or at a rock concert), the MEMS vibration sensor instead of (or in addition to) the MEMS microphone may be used to detect the vocal sound using mechanical vibrations. The device therefore provides the advantage of being able to detect vocal sounds through vibration and/or air, and can be used to eliminate and/or minimize unwanted sounds in loud environments and improve vocal sound detection quality.

For example, in one aspect, the MEMS vibration sensor is mainly used to detect desired vocal sounds and eliminate undesirable environmental sounds. For example, the MEMS vibration sensor is used to detect vocal sound, not through air pressure change, but through mechanical vibration caused by the sound source, for example skin vibrations of the neck near the vocal cord. In addition, the MEMS microphone and vibration sensor die or package may include an application-specific integrated circuit (ASIC) die or system having electronic circuits with filters and equalizers to optimize sound signals and minimize unwanted environmental sounds by filtering, switching and/or amplifying signals from both the vibration sensor and microphone sensors selectively along desired audio frequency ranges. In one aspect, the microphone, the vibration sensor and the ASIC die may be integrated into a single package, as a single component. In another aspect, the microphone and vibration sensor are integrated in a single silicon die using MEMS processes. In another aspect, the microphone, the vibration sensor and signal conditioning components are integrated in a system board. The integrated microphone and vibration sensor die or package may be mounted in the controller part of an earpiece or headphone, by which a user can hold and move the device to touch or contact the skin of the neck to pick up the mechanical vibrations from the vocal cord. The controller may have a capacitive contact sensor (or mechanical button or motion sensor) switch on an inner side of the enclosure to detect the contact with the skin when the user holds and moves the device to the skin. The device can then send a signal indicating the user is using the controller for contact vibration sensing mode to the system, and the system can then turn on the vibration sensor and implement protocols for detecting sound through the vibration sensor and/or the microphone.

More specifically, in one embodiment, the MEMS microphone and vibration sensor die includes a die substrate, a MEMS microphone on the die substrate, and a MEMS vibration sensor on the die substrate. The MEMS vibration sensor may have a plurality of beam transducers and each of the plurality of beam transducers may have a beam and a proof mass. Each proof mass may be tuned to a different resonant frequency range and comprises a same material as the die substrate. In addition, in one embodiment, each beam may have a same length and/or each proof mass may have a different length dimension than another of the proof masses. In another aspect, the MEMS microphone may include a diaphragm made of a same material as the beams (e.g., a polysilicon material). In still further aspects, the MEMS vibration sensor may be operable to detect mechanical vibrations at a frequency range of from 20 Hz to 20 kHz, or different frequency ranges within that of human hearing, for example, a low frequency range (e.g., less than or equal to 100 Hz to 1 kHz), a middle frequency range (e.g., 1 kHz to 10) or a high frequency range (e.g., 10 kHz to 20 kHz). For example, in one embodiment, the proof mass of a first beam transducer is tuned to detect a mechanical vibration in a first frequency range and the proof mass of a second beam transducer is tuned to detect a mechanical vibration within a second frequency range that is different than the first frequency range. Representatively, the first beam transducer may detect a mechanical vibration in a low (e.g., less than or equal to 100 Hz to 1 kHz), middle (e.g., 1 kHz to 10 kHz) or high (e.g., 10 kHz to 20 kHz) frequency range, and the second beam transducer may detect a mechanical vibration outside of the range detected by the first beam transducer. In still further embodiments, the MEMS microphone and MEMS vibration sensor may detect vibrations within different frequency ranges. For example, the MEMS microphone may detect an acoustic vibrations within the mid to high frequency ranges (e.g., 1 kHz to 20 kHz) and the MEMS vibration sensor may detect mechanical vibrations within a low frequency range (e.g., 100 Hz to 1 kHz). In another aspect, the MEMS microphone and the MEMS vibration sensor are integrally formed with the die substrate as one integrally formed unit, and the integrally formed unit is mounted to a package substrate. The MEMS microphone and vibration sensor die may be incorporated into a remote control housing for a headphone.

In another embodiment, a headphone remote controller having multiple sensors is provided. The headphone remote controller may include a housing for a remote controller of a headphone, which includes a housing wall defining a vibration contact side for the remote controller. In addition, the controller may include a multiple sensor package positioned within the housing. The multiple sensor package may include a MEMS microphone, a plurality of MEMS beam transducers having different proof masses corresponding to different resonant frequencies, and an application-specific integrated circuit (ASIC) electrically connected to the MEMS microphone and the MEMS beam transducers. In addition, the controller may include a printed circuit board (PCB) positioned within the housing to which the multiple sensor package is mounted to the PCB. In addition, a capacitive contact sensor may be mounted to the wall defining the vibration contact side for the remote controller. In one aspect, the multiple sensor package is mounted to a side of the PCB facing the vibration contact side for the remote controller. In addition, the different proof masses may be connected to a plurality of beams, and each of the beams have a same length dimension. Still further, the MEMS microphone and the plurality of beam transducers may be integrally formed with a die substrate as a single integrally formed unit, and the single integrally formed unit is mounted to a package substrate. The MEMS microphone may be connected to a first die substrate and the plurality of beam transducers may be connected to a second die substrate, and the first die substrate and the second die substrate may be separately mounted to the package substrate. In one embodiment, the MEMS microphone is operable to sense air pressure changes corresponding to a first frequency range and the plurality of beam transducers are operable to sense mechanical vibrations corresponding to a second frequency range. In addition, the capacitive contact sensor may include a pattern of contacts operable to detect a contact between the housing and a user. For example, a width of the contact with respect to the pattern of contacts is used to differentiate between a first contact indicating a user is using the remote controller to control the headphone and a second contact indicating the user is sensing a vocal cord vibration through the user's skin.

In still further embodiments, a process for manufacturing a MEMS microphone and vibration sensor die is disclosed. Representatively, the process may include providing a substrate and forming a MEMS microphone and a MEMS vibration sensor from the substrate. The MEMS microphone may include a diaphragm and a top plate suspended over a first opening in the substrate. The MEMS vibration sensor may include a plurality of beam transducers with different resonant frequencies, each of the plurality of beam transducers having a beam and a proof mass suspended over a second opening in the substrate. In one embodiment, the diaphragm and the beam of each of the plurality of beam transducers is formed from a polysilicon layer formed over the substrate. In one embodiment, forming the MEMS microphone and MEMS vibration sensor may include etching the substrate to form a microphone cavity and a vibration sensor cavity, depositing a first sacrificial layer within the microphone cavity and the vibration sensor cavity, depositing the polysilicon layer over the first sacrificial layer; and patterning the polysilicon layer to form the diaphragm of the MEMS microphone and the beam of each of the plurality of beam transducers. The proof mass for each of the beam transducers may be formed within the vibration sensor cavity during etching. In one embodiment, the polysilicon layer is a first polysilicon layer, and forming further includes depositing a second sacrificial layer over the diaphragm and the beam, depositing a second polysilicon layer over the sacrificial layer, patterning the second polysilicon layer to form a first top plate over the diaphragm and a second top plate over the beam, etching a back side of the substrate to form the first opening and the second opening, and using the first opening and the second opening, wet etching the first sacrificial layer and the second sacrificial layer to release the diaphragm, the beam and the proof mass.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the embodiments. In other instances, well-known semiconductor processes and manufacturing techniques have not been described in particular detail in order to not unnecessarily obscure the embodiments. Reference throughout this specification to "one embodiment" means that a particular feature, structure, configuration, or characteristic described in connection with the embodiment is included in at least one embodiment. Thus, the appearances of the phrase "in one embodiment" in various places throughout this specification are not necessarily referring to the same embodiment. Furthermore, the particular features, structures, configurations, or characteristics may be combined in any suitable manner in one or more embodiments. The terms "over", "to", and "on" as used herein may refer to a relative position of one feature with respect to other features. One feature "over" or "on" another feature or bonded "to" another feature may be directly in contact with the other feature or may have one or more intervening layers.

Figure 1:
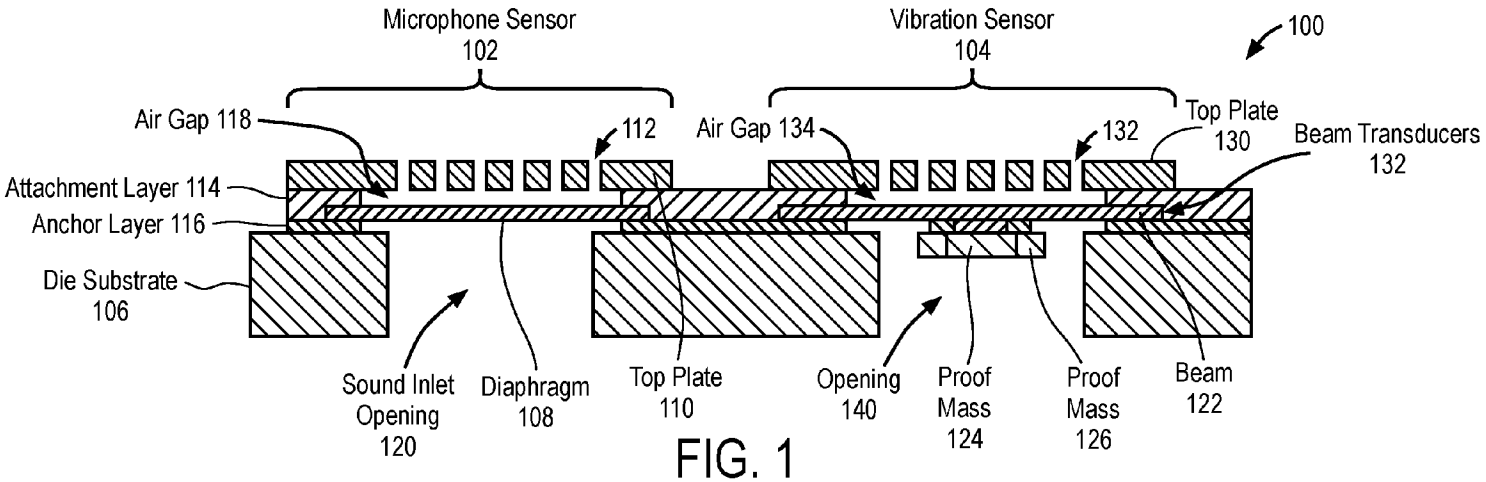
FIG. 1 is a cross-sectional side view illustration of a MEMS microphone and vibration sensor die in accordance with an embodiment.

FIG. 1 is a cross-sectional side view illustration of a MEMS microphone and vibration sensor die in accordance with an embodiment. As shown, the MEMS microphone and vibration sensor die 100 may include a MEMS microphone 102 and a MEMS vibration sensor 104 formed within a single die substrate 106. In other words, the MEMS microphone 102 and MEMS vibration sensor 104 may be integrally formed using MEMS processing technology as a single unit, such that they are not separable from one another or the die substrate 106.

The MEMS microphone 102 may include a diaphragm 108 and a top plate 110 positioned over, or above, a sound inlet opening 120 formed in the die substrate 106. MEMS microphone 102 may further include an anchor layer 116 between the diaphragm 108 and die substrate 106. In addition, an attachment layer 114 may be formed between the diaphragm 108 and the top plate 110. The attachment layer 114 spaces the diaphragm 108 apart from the top plate 110 so that an air gap 118 for capacitance measurement is formed between the diaphragm 108 (which may function as a movable bottom electrode) and the top plate 110 (which may function as a fixed top electrode). The top plate 110 may further include perforations 112 to allow for air to flow through the top plate 110. During operation, sound waves travel through the sound inlet opening 120 causing the diaphragm 108 (which is a relatively thin solid structure) to move or vibrate in response to the change in air pressure caused by the sound waves. The movement of diaphragm 108 creates a change in the amount of capacitance between the top plate 110 (which is a relatively stiff structure) and the diaphragm 108, which is then translated into an electrical signal by, for example, an application-specific integrated circuit (ASIC) (not shown).

MEMS vibration sensor 104 may be a multi resonance frequency beam (MRFB) vibration sensor with multiple beam transducers having different proof masses that can be used to improve vibration sensitivity of the device in wide frequency ranges and/or low frequency ranges. For example, the MEMS vibration sensor 104 may be used to detect mechanical vibrations within a same, or different, frequency range as the MEMS microphone 102, for example, a frequency range of from about 20 Hz to about 20 kHz. In this aspect, the MEMS vibration sensor 104 can be used to maximize a vibration sensitivity of the MEMS microphone within a range of human hearing. Representatively, in some cases, vocal sounds and unwanted environmental sounds are within the same frequency ranges, for example, low frequency ranges. Therefore, when the MEMS microphone 102 detects sounds within these ranges through air, some may be wanted (e.g., vocal sounds) while others are unwanted (e.g., traffic sounds), yet the MEMS microphone 102 picks up both. The MEMS vibration sensor 104, however, is configured to detect vocal sounds through mechanical vibrations of a vibrating surface of the user (e.g., skin near the vocal cords). Thus, in a noisy environment where the level of unwanted sounds is high, the MEMS microphone 102 may be inactivated, and the MEMS vibration sensor 104 is instead used to detect only the vocal sounds through the vibration of the skin around the users vocal cords. In this aspect, the other unwanted environmental sounds (e.g., traffic, rock concert noise, subway, etc.), which the MEMS microphone 102 would normally pick up through the air, are eliminated.

In this aspect, the MEMS microphone 102 and MEMS vibration sensor 104 may detect sounds within a same frequency range (e.g., 20 Hz to 20 kHz), while in other embodiments, the MEMS microphone 102 and the MEMS vibration sensor 104 may detect sounds within different and/or overlapping frequency ranges. For example, the MEMS vibration sensor 104 may detect low frequency mechanical vibrations (e.g., less than or equal to 100 Hz to 1 kHz) and the MEMS microphone 102 may detect acoustic vibrations in the middle frequency range (e.g., 1 kHz to 10 kHz) and/or high frequency range (e.g., 10 kHz to 20 kHz).

In addition, the MEMS vibration sensor 104 may include one or more beam transducers 132 having beams 122, 128 (see FIG. 2) and proof masses 124, 126 which are tuned to have different resonant frequencies such that the beam transducers 132 can detect mechanical vibrations within different frequency ranges. It should be understood that a "mechanical vibration" is intended to refer to a vibrating surface or structure, the vibrations of which can be detected by contacting the MEMS vibration sensor 104 with the vibrating surface, as opposed to vibrations that are detected through air by the MEMS microphone 102, and referred to herein as acoustic vibrations.

In one embodiment, the dimensions of beams 122, 128 may be the same while the dimensions (or mass) of proof masses 124, 126 may be different (or tuned) so that the transducers have different resonant frequencies which correspond to a desired frequency range. For example, proof mass 124 may have a smaller area or mass than proof mass 126. In this aspect, the transducer having proof mass 124 has a higher resonant frequency than the transducer having proof mass 126. For example, in one embodiment, both proof masses 124 and 126 may be used to detect low frequency vibrations, however, proof mass 126 may be tuned to detect frequencies within the low end of the low frequency range (e.g., 100 Hz to 500 Hz) and proof mass 124 may be tuned to detect frequencies within the high end of the low frequency range (e.g., 500 Hz to 1 kHz). Alternatively, proof mass 126 may be tuned so that the beam transducer detects mechanical vibrations with the low frequency range (e.g., 100 Hz to 1 kHz), the middle frequency range (e.g., 1 kHz to 10 kHz) and/or the high frequency range (e.g., 10 kHz to 20 kHz) and proof mass 124 may be tuned so that the other beam transducer detects mechanical vibrations outside the range of the transducer with proof mass 126.

The beams 122, 128 may be positioned over (or above) an opening 140 within die substrate 106. Similar to the MEMS microphone 102, MEMS vibration sensor 104 may further include anchor layer 116 between the beams 122, 128 and die substrate 106 and attachment layer 114 between the beams 122, 128 and a top plate 130. In this aspect, it should be recognized that because both the MEMS microphone 102 and MEMS vibration sensor 104 are formed using MEMS processing steps, they have components formed from a same material layer (e.g., diaphragm 108 and beams 122, 128) and/or share at least one common material layer (e.g., the anchor layer 116 or the attachment layer 114). In addition, an air gap 134 for capacitance measurement is formed between the beams 122, 128 (which may function as a movable bottom electrode) and the top plate 130 (which may function as a fixed top electrode). The change in capacitance due to the movement of the beams 122, 128 is then translated into an electrical signal by the same ASIC (not shown) used for the MEMS microphone 102.

Figure 2:
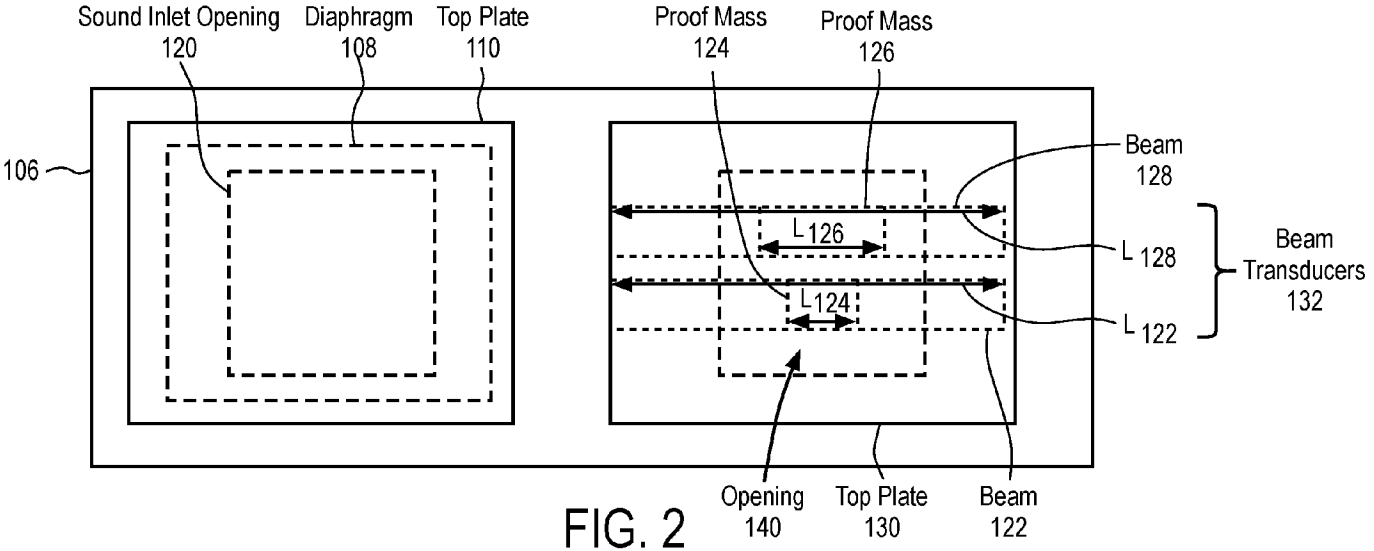
FIG. 2 is a schematic top view illustration of the MEMS microphone and vibration sensor die of FIG. 1.
Figure 3:
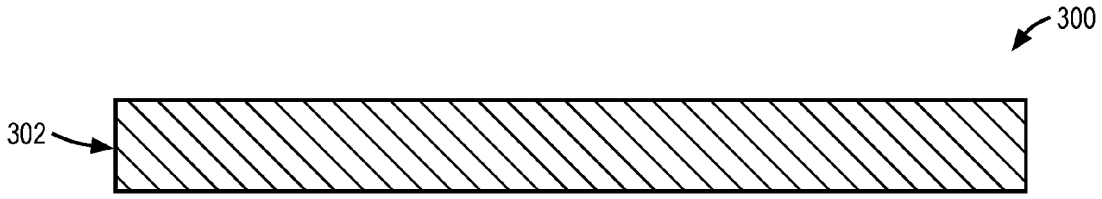
FIGS. 3-14 illustrate a process for manufacturing a MEMS microphone and vibration sensor die in accordance with an embodiment.

FIG. 2 is a schematic top view illustration of the MEMS microphone and vibration sensor die of FIG. 1. From this view, the dimensions of beams 122, 128 and proof masses 124, 126 can be seen. In particular, the dimensions of beam 122 and beam 128 may be substantially the same. Representatively, length ($L_{122}$) of beam 122 may be substantially the same as length ($L_{128}$) of beam 128. The dimensions or masses of proof mass 124 and proof mass 126 may be different. Representatively, length ($L_{124}$) of proof mass 124 may be shorter than the length ($L_{126}$) of proof mass 126. It should further be understood that while different lengths are used to illustrate the different dimensions or masses of proof masses 124, 126, it is contemplated that a width, thickness, or other aspect of the proof mass dimension may be changed in order to achieve a multi frequency vibration sensor.

FIGS. 3-14 illustrate a process for manufacturing a MEMS microphone and vibration sensor die in accordance with an embodiment. Representatively, according to FIG. 3, process 300 includes the initial processing operation of providing a substrate 302. Substrate 302 may, for example, be a silicon or Silicon-on-Insulator (SOI) substrate wafer from which the MEMS microphone and MEMS vibration sensor can be formed to produce a multi frequency MEMS microphone and vibration sensor die.

Figure 4:
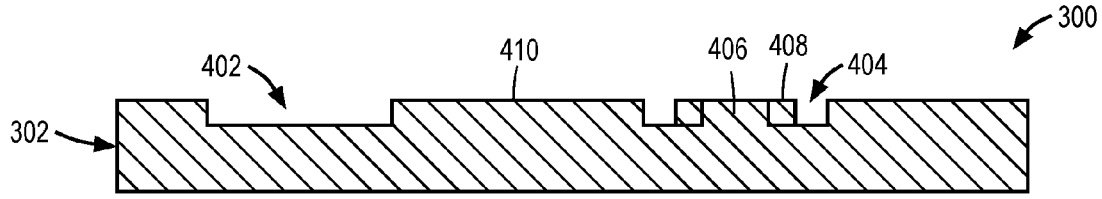

FIG. 4 illustrates the further processing operation of forming a microphone cavity 402 and a vibration sensor cavity 404 within a top side 410 of substrate 302. Representatively, microphone cavity 402 and vibration sensor cavity 404 may be formed using a deep reactive ion etching (DRIE) process. The vibration sensor cavity 404 may be formed to include two separate masses 406 and 408 (e.g., proof masses 124, 126) formed from the substrate 302 (e.g., they include a same material), such as by further masking and etching steps. The different masses 406 and 408 will serve as the proof masses (e.g., proof masses 124, 126) for the multi frequency beam transducers of the vibration sensor. In this aspect, the masses 406 and 408 will be formed to have a desired size and/or mass so that the corresponding transducers have the desired resonant frequencies (e.g., different resonant frequencies).

Figure 5:
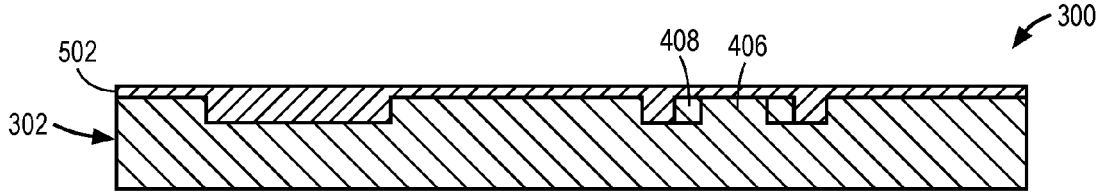

FIG. 5 illustrates the further processing operation of depositing sacrificial layer 502 over the top side 410 of substrate 302 and within microphone cavity 402 and vibration sensor cavity 404. In particular, the sacrificial layer 502 may be a layer of material applied over the substrate 302, microphone cavity 402 and vibration sensor cavity 404, such that it fills the cavities and surrounds the masses 406 and 408 within vibration sensor cavity 404. Once the cavities are filled, the layer is planarized, such as by chemical mechanical planarization (CMP), to remove portions of the layer on the top side 410 of substrate 302 and masses 406 and 408. The sacrificial layer 502 may, for example, be made of silicon dioxide ($SiO_2$).

Figure 6:
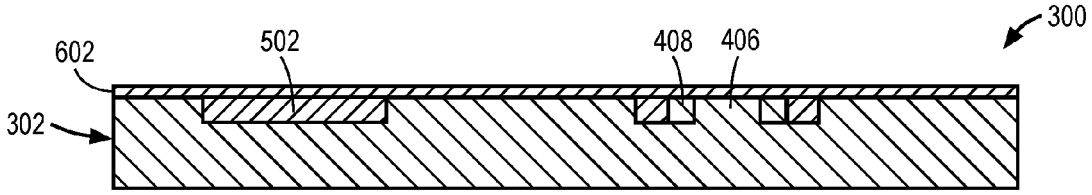

FIG. 6 illustrates the further processing operation of applying an anchor layer 602 over sacrificial layer 502. Representatively, anchor layer 602 may be formed by applying a layer of a suitable material over sacrificial layer 502 and then planarizing the layer (e.g., CMP) to form a smooth layer having a consistent thickness. Similar to the sacrificial layer 502, the anchor layer 602 may, for example, be made of silicon dioxide ($SiO_2$).

Figure 7:
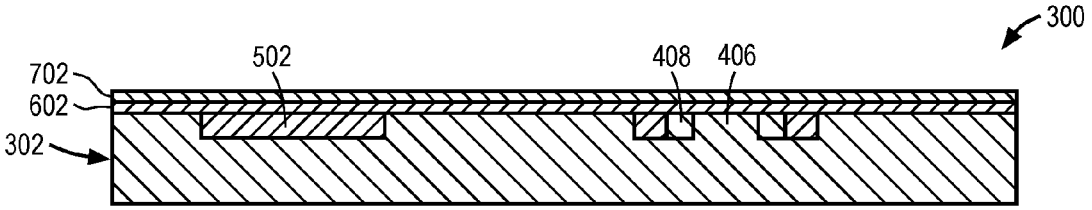

FIG. 7 illustrates the further processing operation of applying a polysilicon layer 702 over the anchor layer 602. The polysilicon layer 702 may then be planarized (e.g., CMP) to form a smooth layer that can then be used to form the diaphragm for the MEMS microphone and beam structures for the MEMS vibration sensor. In this aspect, the diaphragm for the MEMS microphone and the beams for the MEMS vibration sensor may be formed from the same material layer, in other words, formed of a same polysilicon material.

Figure 8:
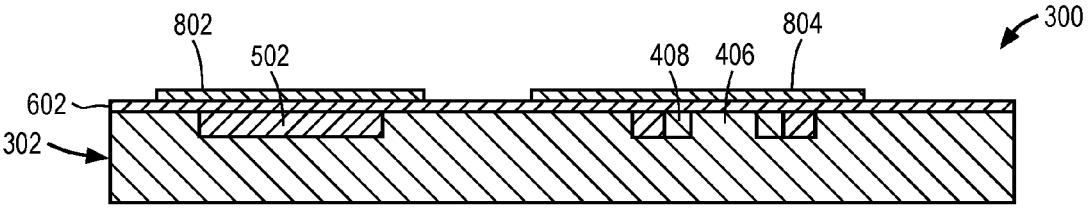

In particular, FIG. 8 illustrates the further processing operation of forming a diaphragm 802 (e.g., diaphragm 108 of FIGS. 1-2) and one or more of a beam 804 (e.g., beams 122, 128 of FIG. 2) from polysilicon layer 702. Representatively, a mask (e.g., patterned photoresist) may be applied over polysilicon layer 702. Portions of the polysilicon layer 702 that are exposed by the mask may then be etched to remove them, leaving behind the diaphragm 802 and one or more of the beam 804 structures. It is noted that from this view, only a single beam 804 can be seen, however, at least two beams as shown, for example, in FIG. 2, are formed over proof mass 406 and proof mass 408.

Figure 9:
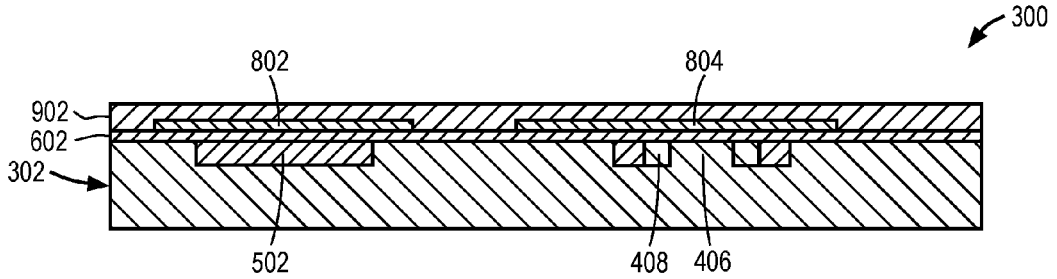

FIG. 9 illustrates the further processing operation of forming another sacrificial layer 902 over anchor layer 602, diaphragm 802 and one or more of the beam 804. Similar to sacrificial layer 502, sacrificial layer 902 may be formed by applying a layer of silicon dioxide ($SiO_2$) over anchor layer 602, diaphragm 802 and one or more of beam 804. The layer of silicon dioxide ($SiO_2$) is then planarized as previously discussed to form sacrificial layer 902.

Figure 10:
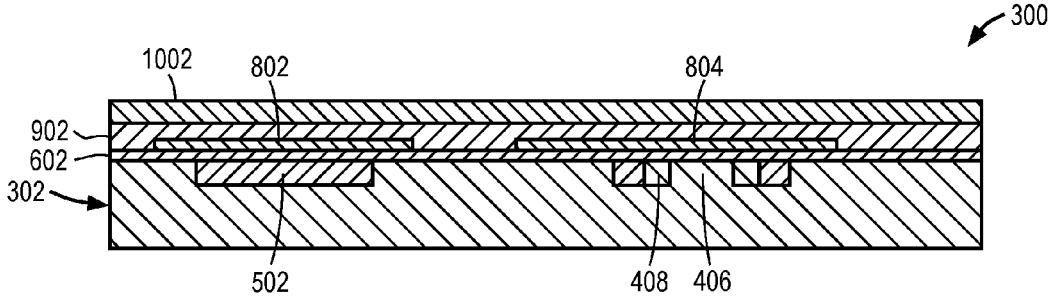

FIG. 10 illustrates the further processing operation of forming another polysilicon layer 1002. Polysilicon layer 1002 is formed by applying a layer of polysilicon over sacrificial layer 902. Polysilicon layer 1002 may be used to form the top plates for each of the MEMS microphone and vibration sensor. Therefore, in one embodiment, the layer of polysilicon used to form polysilicon layer 1002 may be thicker than the layer of polysilicon used to form diaphragm 802 and the beam 804 so that the resulting top plates are relatively stiff, rigid structures in comparison to the diaphragm 802 and beam 804.

Figure 11:
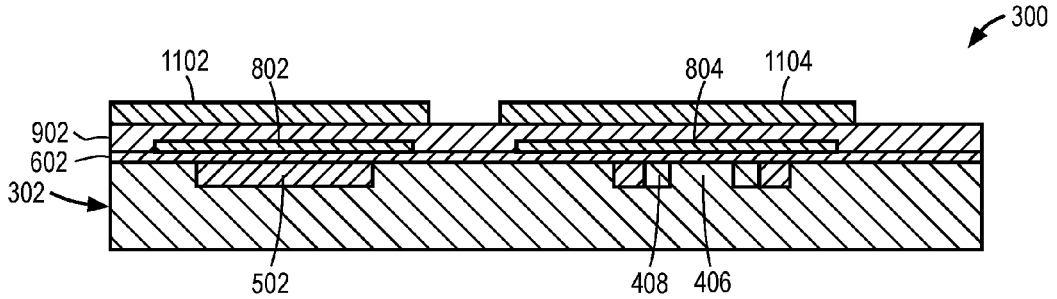

FIG. 11 illustrates the further processing operation of forming a top plate 1102 for the MEMS microphone and top plate 1104 for the MEMS vibration sensor from polysilicon layer 1002. Representatively, a mask (e.g., patterned photoresist) may be applied over polysilicon layer 1002. Portions of the polysilicon layer 1002 that are exposed by the mask may then be etched to remove them, leaving behind top plates 1102 and 1104.

Figure 12:
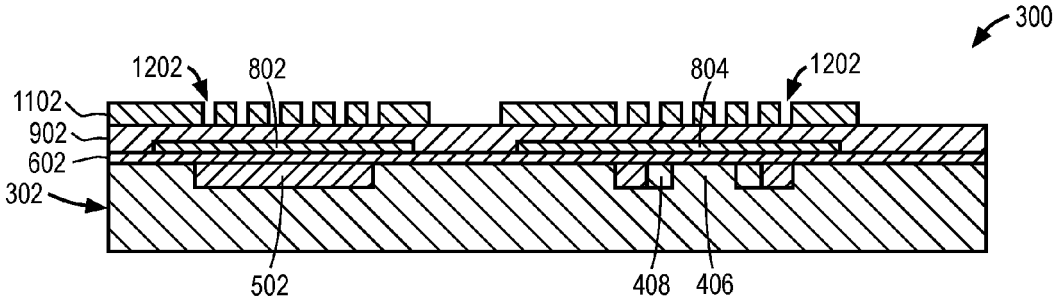

FIG. 12 illustrates the further processing operation of forming perforated openings 1202, in top plate 1102 and top plate 1104 to reduce damping. Representatively, top plate 1102 and top plate 1104 may be patterned to form perforated openings 1202, which extend through the entire thickness of the plates, as shown in FIG. 12.

Figure 13:
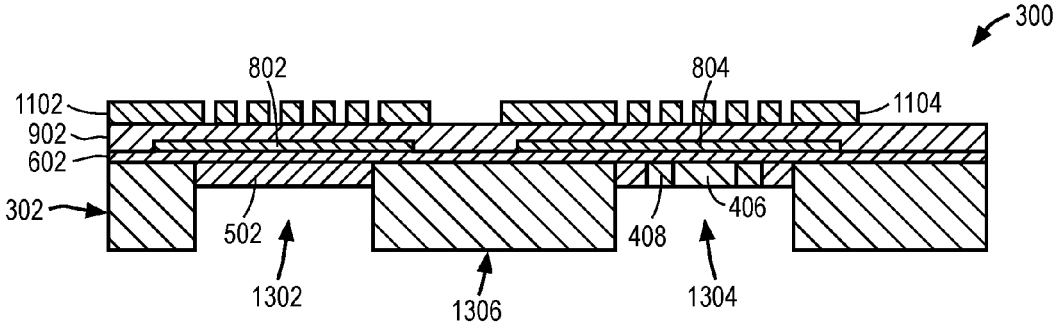

FIG. 13 illustrates the further processing operation of forming openings 1302 and 1304 within a back or bottom side 1306 of substrate 302. Representatively, in one embodiment, a DRIE etching process is performed on the bottom side 1306 of substrate 302 to remove the silicon beneath the sacrificial layer 502 and proof masses 406, 408 and expose the sacrificial layers 502 and 902.

Figure 14:
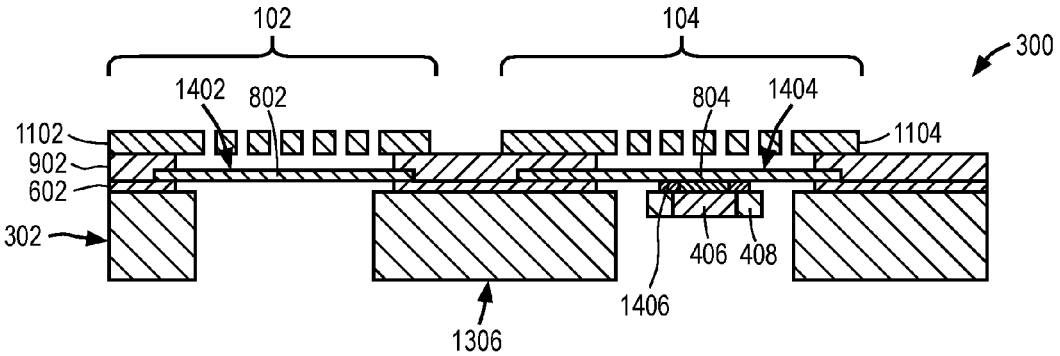

FIG. 14 illustrates the further processing operation of removing portions of the sacrificial layers 502 and 902 and anchor layer 602. Representatively, wet etching is performed, for example through openings 1302 and 1304 or perforated openings 1202, in order to remove a portion of sacrificial layer 902 above diaphragm 802 leaving air gap 1402. In addition, wet etching may be used to remove a portion of sacrificial layer 902 and anchor layer 602 below diaphragm 802. The edges of diaphragm 802, however, remain sandwiched between portions of sacrificial layer 902 and anchor layer 602 surrounding the air gap 1402 and opening 1302 such that diaphragm 802 is suspended over opening 1302 and free to vibrate. Similarly, the wet etching step removes a portion of sacrificial layer 902 above one or more of beam 804 leaving air gap 1404 and a portion of sacrificial layer 902 and anchor layer 602 below beam 804 and surrounding proof masses 406, 408. An anchor layer portion 1406 of anchor layer 602 between one or more of beam 804 and the respective proof masses 406, 408, however, remains such that the anchor layer portion 1406 serves to attach the proof masses 406, 408 to their respective beam 804. In addition, the ends of one or more of beam 804 remain sandwiched between portions of sacrificial layer 902 and anchor layer 602 surrounding the air gap 1404 and opening 1304 such that each beam 804 is suspended over opening 1304. In other words, both of the opposing ends (in the length direction) of beam 804 are attached to, fixed to, or otherwise secured to, substrate 302. The resulting structure is a single, integrally formed die including a MEMS microphone 102 and MEMS vibration sensor 104 as previously discussed in reference to FIGS. 1-2.

It should be understood that although various processing operations are described in FIGS. 3-14, any one or more of these operations may be performed in a different order and/or omitted and/or additional steps may be performed according to manufacturing protocols. Representatively, although a single, integrally formed MEMS microphone and vibration sensor die with inseparable components is disclosed in FIG. 14, in another embodiment, a further sawing step may be used to separate the MEMS microphone 102 from the vibration sensor 104.

The integrated MEMS microphone and vibration sensor die formed using the processing operations described in FIGS. 3-14 may then be integrated within a package assembly for incorporation into a desired device (e.g., a remote controller for a headphone).

Figure 15:
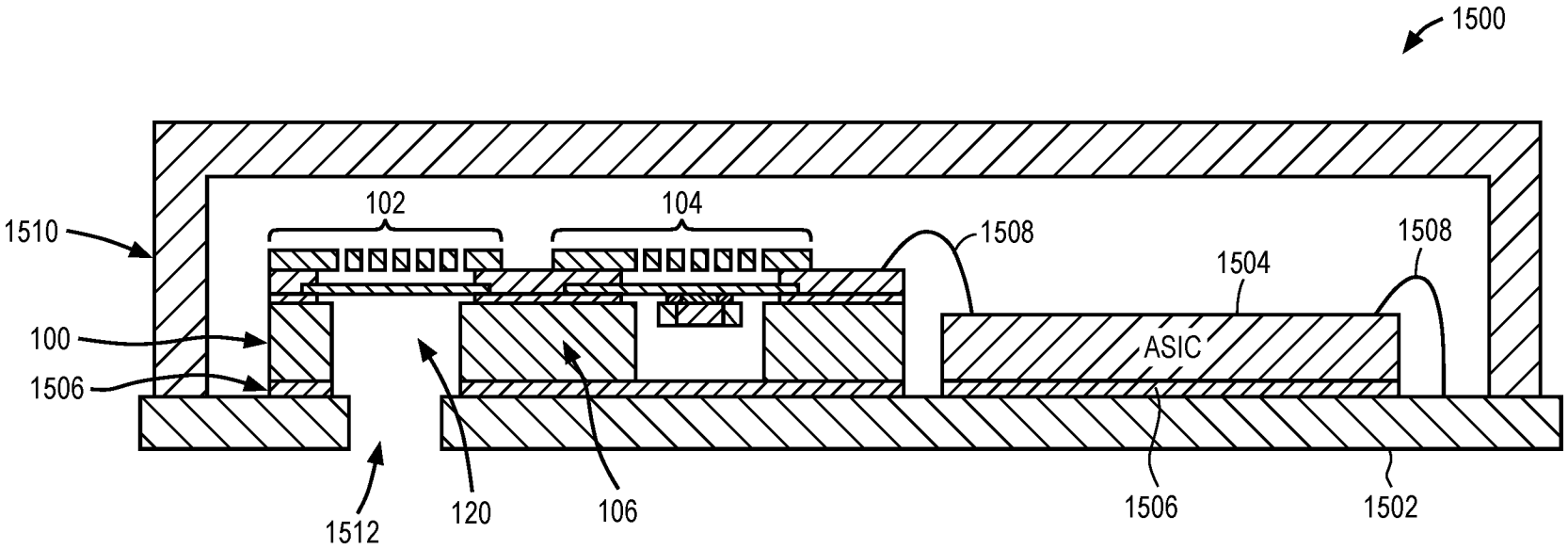
FIG. 15 is a cross-sectional side view illustration of a MEMS microphone and vibration sensor package in accordance with an embodiment.

FIG. 15 is a cross-sectional side view illustration of a MEMS microphone and vibration sensor package in accordance with an embodiment. MEMS microphone and vibration sensor package 1500 may include a multi frequency MEMS microphone and vibration sensor die 100, such as that described in reference to FIGS. 1-2. In particular, MEMS microphone and vibration sensor die 100 may include a MEMS microphone 102 and MEMS vibration sensor 104 integrally formed from die substrate 106 using the processing operations described in FIGS. 3-14. The MEMS microphone and vibration sensor die 100 may be positioned on, and attached to, package substrate 1502. Representatively, the MEMS microphone and vibration sensor die 100 may be stacked on top of package substrate 1502 and a layer of die attach material 1506 positioned between die 100 and package substrate 1502 to mechanically attach the two together. Package substrate 1502 may include a sound inlet port 1512, which aligns with opening 120 through the die substrate 106 to allow for sound inlet to MEMS microphone 102.

The MEMS microphone and vibration sensor package 1500 may further include an IC die 1504, such as an application specific integrated circuit (ASIC) die, positioned on, and attached to, package substrate 1502. Representatively, the layer of die attach material 1506 may be used to attach IC die 1504 to package substrate 1502. In addition, IC die 1504 may be electrically connected to MEMS microphone and vibration sensor die 100 and package substrate 1502 with wire bonds 1508, one between die 100 and IC die 1504 and another between IC die 1504 and package substrate 1502. A package lid 1510 may further be attached to the package substrate 1502 and over the MEMS microphone and vibration sensor die 100 and IC die 1504, to complete the package assembly. Package substrate 1502 may be any suitable substrate, such as land grid array (LGA), quad flat no-leads (QFN), and ceramic packaging substrates.

It should be understood that embodiments are not limited to the specific packaging structure illustrated in FIG. 15, and it is meant to be exemplary in nature. For example, the MEMS microphone and vibration sensor die 100 and IC die 1504 may be stacked on the package substrate 1502 and the wire bonding arrangement included as necessary. Alternatively, bumps (for example, through flip chip) or other techniques for electrically connecting one component to another may be used.

In addition, the IC die 1504 may include a variety of components including an amplifier, ADC, charge pump, clock(s) (or clock inputs) and other signal conditioning components such as spectral mixers. The particular components can vary based on application, and whether the MEMS microphone and/or MEMS vibration sensor are analog or digital. It should be noted that since the MEMS microphone and MEMS vibration sensor are both electrically connected to the IC die 1504, they use the same circuitry and signal conditioning components, which is a further advantage of the integrated MEMS microphone and vibrations sensor die 100. In other configurations, one or more components from the IC die 1504 can be integrated into the MEMS microphone and vibration sensor die 100, and/or other component arrangements used.

Figure 16:
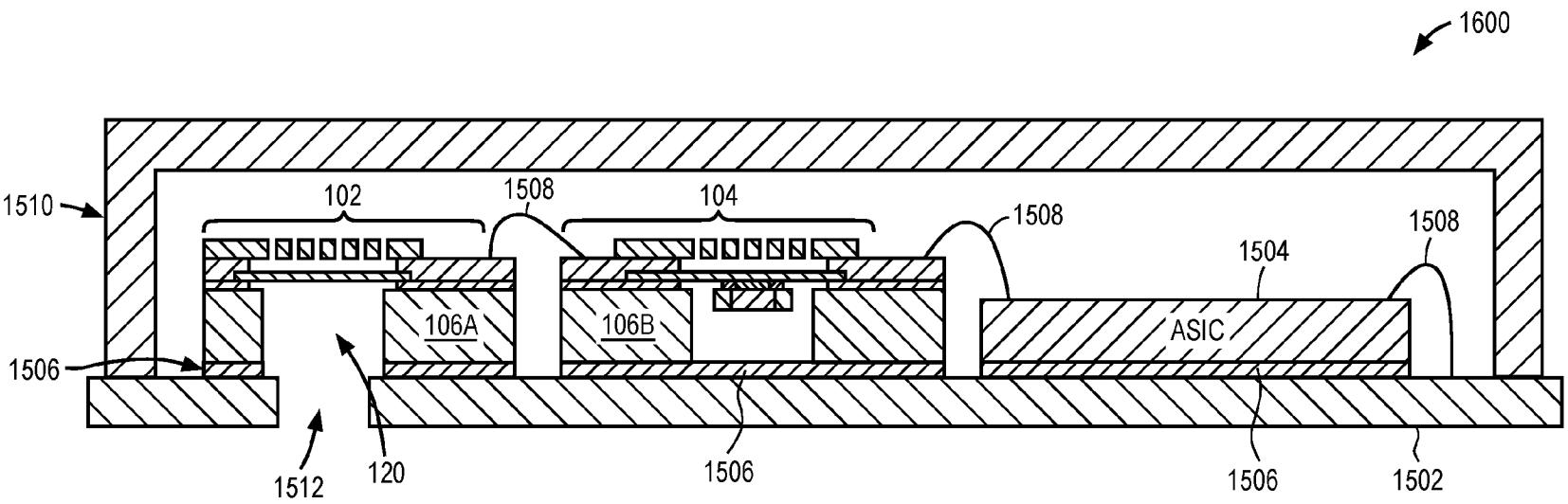
FIG. 16 is a cross-sectional side view illustration of a MEMS microphone and vibration sensor package in accordance with another embodiment.

FIG. 16 is a cross-sectional side view illustration of a MEMS microphone and vibration sensor package in accordance with another embodiment. The MEMS microphone and vibration sensor package 1600 includes substantially the same components as the MEMS microphone and vibration sensor package 1500 described in reference to FIG. 15, except in this embodiment, MEMS microphone 102 and MEMS vibration sensor 104 are separate structures having separate die substrates 106A, 106B, respectively. In this aspect, MEMS microphone 102, including substrate 106A, and MEMS vibration sensor 104, including die substrate 106B, are separately attached to package substrate 1502 with die attach material layer 1506. In addition, because MEMS microphone 102 and MEMS vibration sensor 104 are separate structures, an additional wire bond 1508 is used to electrically connect MEMS microphone 102 to MEMS vibration sensor 104.

Figure 17:
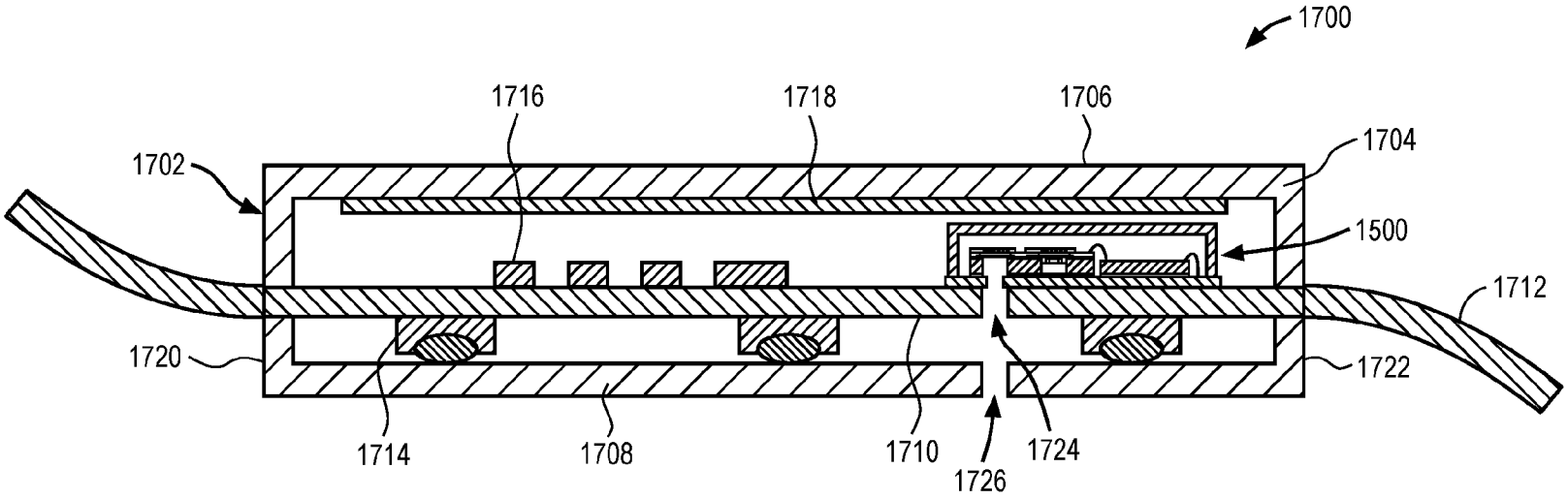
FIG. 17 is a cross-sectional side view illustration of remote controller for a headphone including a MEMS microphone and vibration sensor package in accordance with an embodiment.

FIG. 17 is a cross-sectional side view illustration of remote controller for a headphone including a MEMS microphone and vibration sensor package in accordance with an embodiment. Representatively, FIG. 17 shows a remote controller 1700 including a MEMS microphone and vibration sensor package 1500 (as described in reference to FIG. 15). The remote controller 1700 may be a remote controller used to operate a headphone connected to the controller and therefore, although not shown, may include various components for such an operation. In addition, the remote controller 1700 may be used to sense vocal sounds using the MEMS microphone and vibration sensor package 1500 incorporated therein. It should be further understood that although package 1500 is illustrated, the remote controller 1700 may instead include the MEMS microphone and vibration sensor package 1600 described in reference to FIG. 16, or any other combination of MEMS microphone and vibration sensor components described herein.

Representatively, MEMS microphone and vibration sensor package 1500 may be positioned within remote controller housing 1702. Housing 1702 may include an enclosure wall 1704 having a top wall 1706, a bottom wall 1708 and sidewalls 1720, 1722. Sidewalls 1720, 1722 connect the top wall 1706 to the bottom wall 1708 such that the housing 1702 completely encloses each of the components therein. The top wall 1706 may be considered a contact side for the remote controller in that it is the side the user contacts to the vibration portion of the body (e.g., the skin on the neck) to detect the vocal vibrations. The bottom wall 1708 may include an optional opening 1726 that allows for sound from the environment to travel into the housing 1702, for pick up by the microphone. It should be understood, however, that in some embodiments, opening 1726 may be formed in a different wall, or omitted and instead an air gap formed between the top wall 1706 and bottom wall 1708 allows for sound inlet to housing 1702. The housing 1702, and various components therein, may be connected to the headphones (not shown) by cord 1712, within which the various wires may be contained.

Representatively, the wires within cord 1712 may be electrically connected to a printed circuit board (PCB) 1710 positioned within housing 1702. The MEMS microphone and vibration sensor 1500 may be mechanically and electrically connected to PCB 1710, for example, by solder bumps or the like. The MEMS microphone and vibration sensor package 1500 may be connected to a side of PCB 1710 facing the vibration contact side of the housing 1702, for example, the side facing top wall 1706. During operation, when it is desired to detect the user's vocal sounds using the mechanical vibrations of the vocal cords (e.g., in a loud environment), the top wall 1706 of housing 1702 is pressed against the user's neck (near the vocal cords) and the vocal cord vibrations are transmitted through the contact side of housing 1702 to the MEMS microphone and vibration sensor package 1500. For example, the vibrations travel through top wall 1706, side wall 1722, the PCB 1710 and are then picked up by the vibration sensor within MEMS microphone and vibration sensor 1500 attached to PCB 1710. The PCB 1710 may further include a sound inlet port 1724 that is aligned with the sound inlet opening of the MEMS microphone (e.g., sound inlet opening 1512 as described in reference to FIG. 15). Sound inlet port 1724 of PCB 1710 allows sound waves passing through the optional opening 1726 within the enclosure wall 1704 of housing to travel to, and be picked up by, the microphone.

Remote controller 1700 may further include a capacitive contact sensor 1718 positioned along an inner surface of housing wall 1704. The capacitive contact sensor 1718 may be used to differentiate between contact with a user's finger, for example, for normal remote control operations (e.g., for controlling the headphone) and contact with the skin on the neck to detect vocal cord vibrations. In particular, the contact sensor 1718 may be positioned along an inner surface of the contact side or top wall 1706 of housing 1702. When the user presses the contact side or top wall 1706 of housing 1706 against the neck to detect vocal cord vibrations (e.g., mechanical vibrations), the contact sensor 1718 signals to the MEMS microphone and vibration sensor package 1500 that vocal cord vibration sensing is desired and therefore sound should be detected using the vibration sensor within package 1500, instead of, or in addition to the MEMS microphone. Alternatively, when contact sensor 1718 senses that the user is touching the contact side or top wall 1706 with their finger, such as to control headphone operations, the contact sensor 1718 does not send a signal to use the vibration sensor for vocal sound pick-up and the MEMS microphone continues to pick up vocal sounds through the air. It should further be understood that while a capacitive contact sensor is shown, other types of contact sensors may be used to switch the MEMS microphone and vibration sensor between normal and vibration sensing modes. For example, a contact sensor such as a motion (e.g., accelerometer) or mechanical sensor may be mounted within remote controller 1700.

Figure 18:
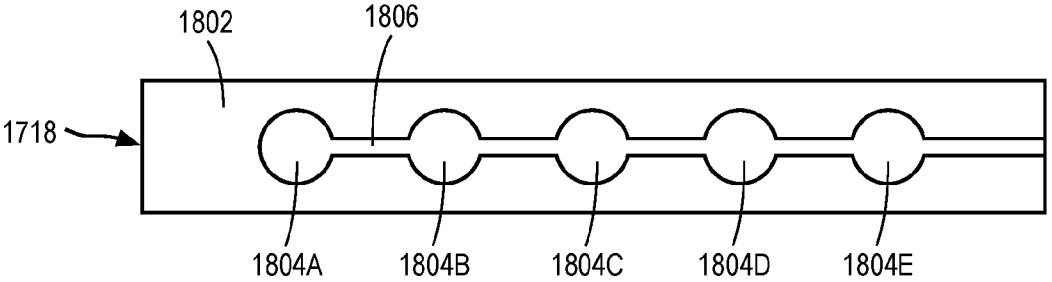
FIG. 18 is a schematic top view of a contact sensor incorporated into the remote controller of FIG. 17.

FIG. 18 is a schematic top view of the contact sensor of FIG. 17. From this view, it can be seen that contact sensor 1718 includes a support member 1802 with a number of contact sensing regions 1804A, 1804B, 1804C, 1804D and 1804E positioned in a desired sensing pattern, and connected by a contact strip 1806 (e.g., a silver or copper tape). The sensing pattern may be such that the contact sensing regions 1804A-1804E are distributed across a length of the support member 1802. In this aspect, the difference between contact by a finger, such as to control the headphones, and contact with the skin on a user's neck, such as to initiate vibration sensing, can be distinguished based on the coverage area of the contact. In other words, if a touch is sensed at only one contact region, e.g., contact sensing region 1804C, the contact sensor 1718 characterizes this as contact by a finger for a headphone operation. In contrast, if a touch is sensed over a wider area, for example at least two or more of contact sensing regions 1804A-1804E, e.g., contact sensing regions 1804A, 1804B, 1804C and 1804D, the contact sensor 1718 characterizes this as a contact with the skin on a user's neck and vibration sensing is initiated. Although not shown, the contact sensor 1718 may further include a wire electrically connecting the contact sensor 1718 to a controller within PCB 1710.

Returning to FIG. 17, controller 1700 may further include passive components 1716, or other IC components, and one or more mechanical switches 1714 connected to PCB 1710 for controlling headphone operations (e.g., volume adjustment, on/off modes, etc.).

Figure 20:
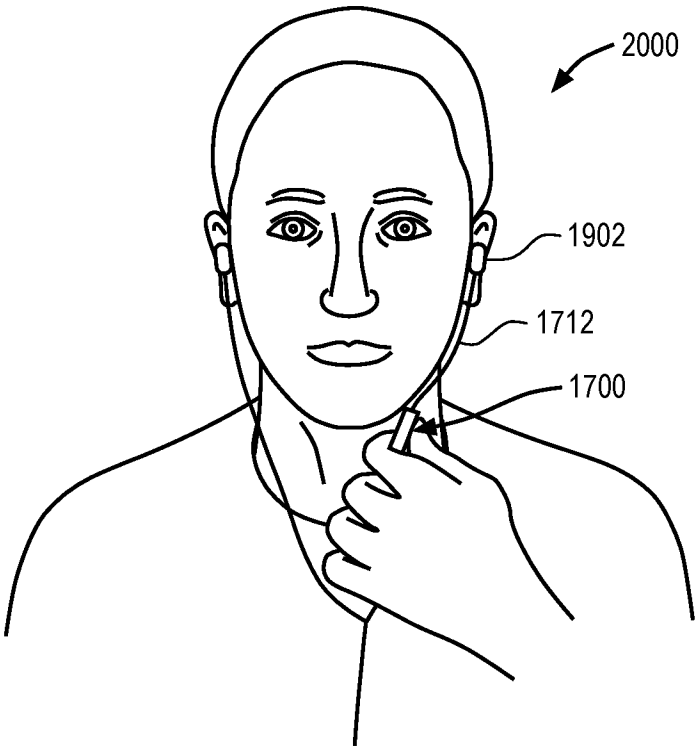
FIG. 20 is a schematic illustration of another application of the remote controller of FIG. 17 by a user in accordance with an embodiment.
Figure 19:
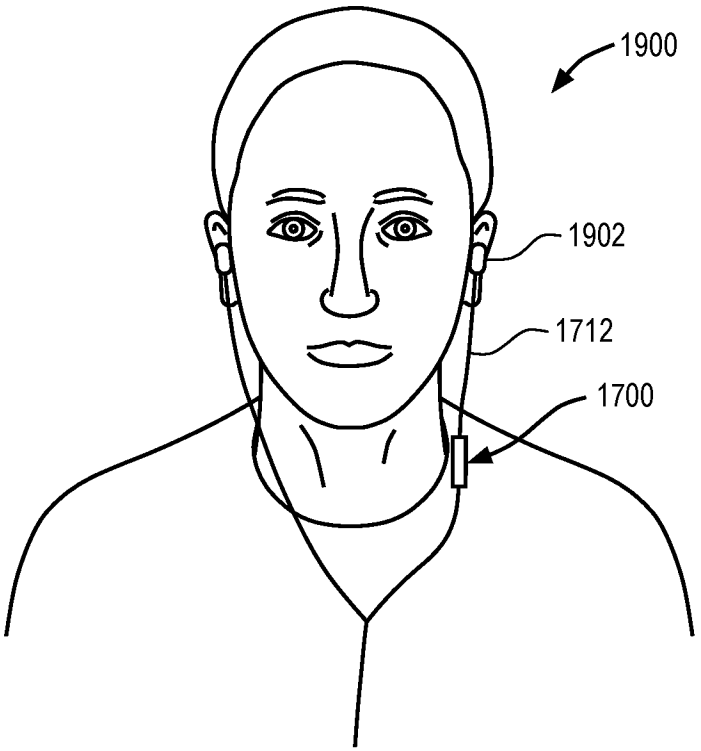
FIG. 19 is a schematic illustration of one application of the remote controller of FIG. 17 by a user in accordance with an embodiment.

FIGS. 19-20 are schematic illustrations of the application of the remote controller of FIG. 17 by a user in a normal (headphone control) mode and a vibration detection mode. Representatively, FIG. 19 shows the remote controller 1700 in the normal mode and FIG. 20 shows the remote controller 1700 in a vibration mode. In particular, in FIG. 19, in the normal mode 1900, a user is shown with the headphones 1902 (e.g., earbuds) positioned in each ear and remote controller 1700 hanging from headphones 1902 by cord 1712. This is considered a "normal mode" in that the remote controller 1700 is being used to control the headphone operations, or for normal microphone operations (e.g., to pick up vocal sounds through the air). In contrast, FIG. 20 shows the vibration mode 2000, in which the user is touching the contact side of the remote controller to the neck skin near the user's vocal cords. Due to the wide contact area caused by the skin on the users neck, the contact sensor within the remote controller 1700 senses this as a vibration sensing contact and signals to the MEMS microphone and MEMS vibration sensor within the remote controller 1700 to pick-up the mechanical vibrations using the vibration sensor.

Figure 21:
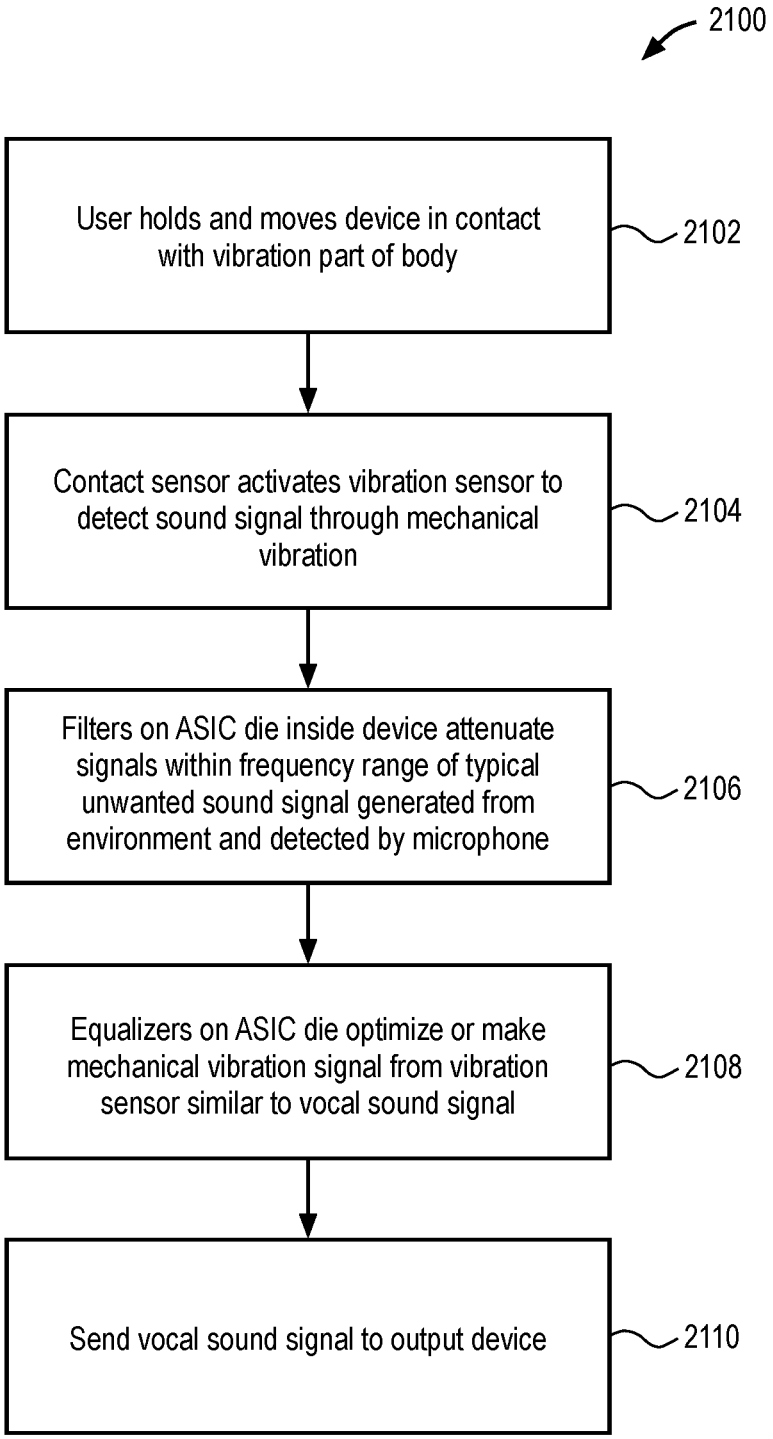
FIG. 21 is a process flow for reducing unwanted environmental sound and optimizing desired sound signal using a MEMS microphone and vibration sensor die in accordance with an embodiment.

FIG. 21 is a process flow for reducing unwanted environmental sound and optimizing desired sound signals using a MEMS microphone and vibration sensor die in accordance with an embodiment. Representatively, according to one process for reducing unwanted environmental sound and optimizing desired sound, the process 2100 includes holding a remote controller including a MEMS microphone and vibrations sensor die package (e.g., remote controller 1700) and moving the remote controller so that it touches a vibration surface (e.g., neck) of the user's body (block 2102). Based on the movement, the contact sensor within the remote controller senses that mechanical vibration sensing of the vocal cord vibrations through the user's skin with the vibration sensor is desired by the user (as opposed to through the air), and sends a signal to the vibration sensor to switch to vibration sensing mode and detect vocal sounds through mechanical vibrations (e.g., vibration of the skin around the vocal cords) (block 2104). The contact sensor may, for example, be a capacitive contact sensor as previously discussed, or a motion (e.g., accelerometer) or mechanical sensor mounted to the remote controller, or integrated within the MEMS microphone and vibration sensor package. Once in vibration mode, filters on the ASIC die associated with the MEMS microphone and vibration sensor die may attenuate signals within frequency ranges where typical unwanted sounds occur and that are typically detected by the MEMS microphone (block 2106). Alternatively, MEMS microphone may be inactivated or turned to stand by mode, so that unwanted sound pick up through air by the MEMS microphone is completely eliminated. In addition, equalizers on the ASIC die may be used to optimize or otherwise make mechanical vibration signals (e.g., vocal cord vibrations) detected by the vibration sensor similar to vocal signals (block 2108). Once processed, the signals may be output to an end user (block 2110).

Figure 22:
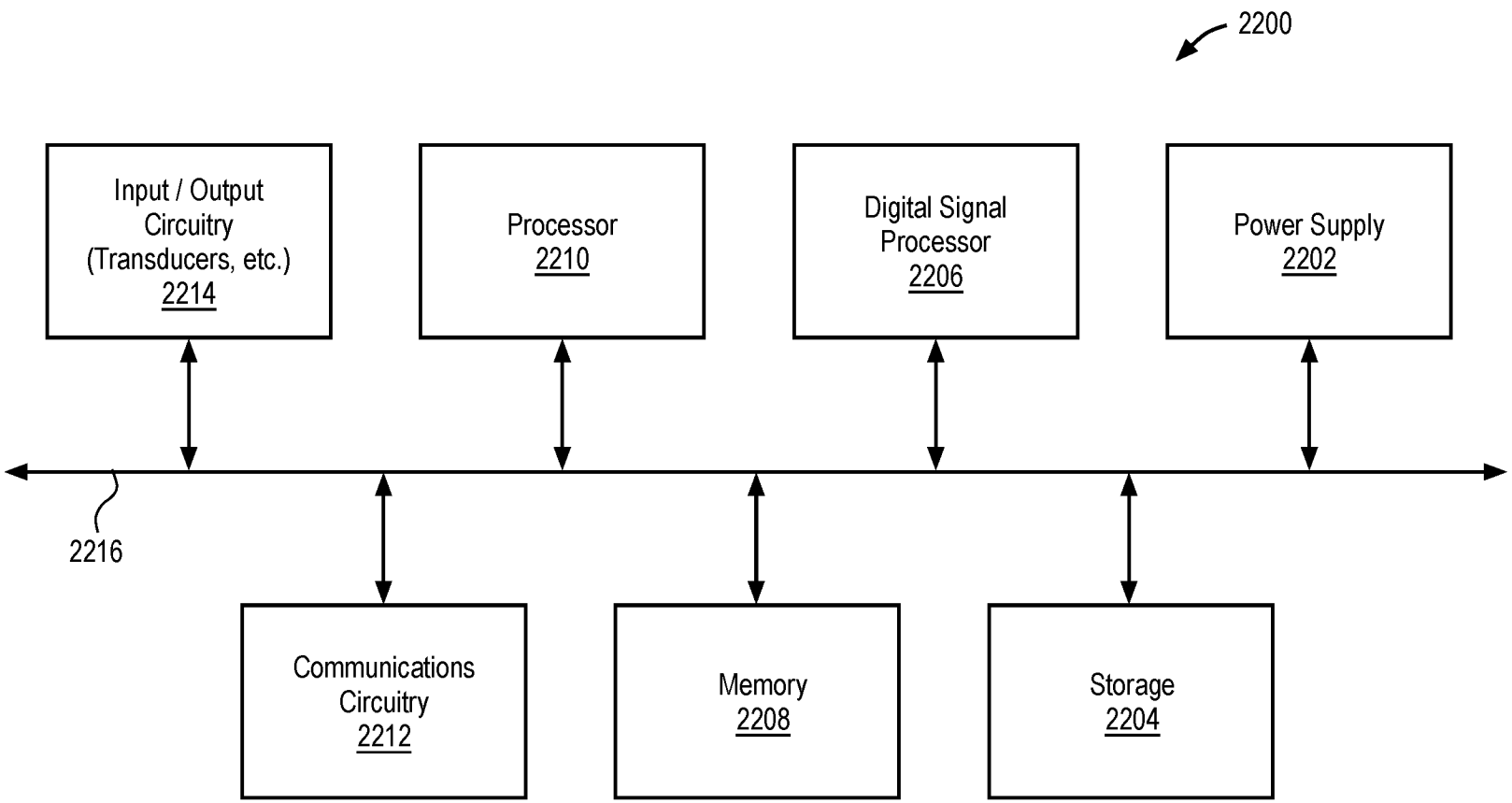
FIG. 22 illustrates a simplified schematic view of one embodiment of an electronic device in which a MEMS microphone and vibration sensor die and/or package as disclosed herein may be implemented.

FIG. 22 illustrates a simplified schematic view of one embodiment of an electronic device in which a MEMS microphone and vibration sensor die and/or package as disclosed herein may be implemented. For example, a remote controller for a headphone, such as an inter-canal earphone or an intra-concha earphone, as discussed in reference to FIGS. 17-20 are examples of systems that can include some or all of the circuitry illustrated by electronic device 2200.

Electronic device 2200 can include, for example, power supply 2202, storage 2204, signal processor 2206, memory 2208, processor 2210, communication circuitry 2212, and input/output circuitry 2214. In some embodiments, electronic device 2200 can include more than one of each component of circuitry, but for the sake of simplicity, only one of each is shown in FIG. 22. In addition, one skilled in the art would appreciate that the functionality of certain components can be combined or omitted and that additional or less components, which are not shown in FIG. 22, can be included in, for example, the remote controller device 1700 described in FIG. 17.

Power supply 2202 can provide power to the components of electronic device 2200. In some embodiments, power supply 2202 can be coupled to a power grid such as, for example, a wall outlet. In some embodiments, power supply 2202 can include one or more batteries for providing power to earphones, headphones or other type of electronic device associated with the headphone. As another example, power supply 2202 can be configured to generate power from a natural source (e.g., solar power using solar cells).

Storage 2204 can include, for example, a hard-drive, flash memory, cache, ROM, and/or RAM. Additionally, storage 2204 can be local to and/or remote from electronic device 2200. For example, storage 2204 can include an integrated storage medium, removable storage medium, storage space on a remote server, wireless storage medium, or any combination thereof. Furthermore, storage 2204 can store data such as, for example, system data, user profile data, and any other relevant data.

Signal processor 2206 can be, for example a digital signal processor, used for real-time processing of digital signals that are converted from analog signals by, for example, input/output circuitry 2214. After processing of the digital signals has been completed, the digital signals could then be converted back into analog signals.

Memory 2208 can include any form of temporary memory such as RAM, buffers, and/or cache. Memory 2208 can also be used for storing data used to operate electronic device applications (e.g., operation system instructions).

In addition to signal processor 2206, electronic device 2200 can additionally contain general processor 2210. Processor 2210 can be capable of interpreting system instructions and processing data. For example, processor 2210 can be capable of executing instructions or programs such as system applications, firmware applications, and/or any other application. Additionally, processor 2210 has the capability to execute instructions in order to communicate with any or all of the components of electronic device 2200.

Communication circuitry 2212 may be any suitable communications circuitry operative to initiate a communications request, connect to a communications network, and/or to transmit communications data to one or more servers or devices within the communications network. For example, communications circuitry 2212 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 2214 can convert (and encode/decode, if necessary) analog signals and other signals (e.g., physical contact inputs, physical movements, analog audio signals, etc.) into digital data. Input/output circuitry 2214 can also convert digital data into any other type of signal. The digital data can be provided to and received from processor 2210, storage 2204, memory 2208, signal processor 2206, or any other component of electronic device 2200. Input/output circuitry 2214 can be used to interface with any suitable input or output devices, such as, for example, a further microphone. Furthermore, electronic device 2200 can include specialized input circuitry associated with input devices such as, for example, one or more proximity sensors, accelerometers, etc. Electronic device 2200 can also include specialized output circuitry associated with output devices such as, for example, one or more speakers, earphones, etc.

Lastly, bus 2216 can provide a data transfer path for transferring data to, from, or between processor 2210, storage 2204, memory 2208, communications circuitry 2212, and any other component included in electronic device 2200. Although bus 2216 is illustrated as a single component in FIG. 22, one skilled in the art would appreciate that electronic device 2200 may include one or more bus components.

It should further be understood that although not specifically disclosed, in accordance with embodiments, other types of vibration sensing transducers may be used that operate in accordance with various transduction principles, such as capacitive, piezoelectric, and piezoresistive. The sensing transducers may, for example, include multiple transducer components per each axis (e.g., X, Y and Z) on a single transducer die, with the multiple transducer components having various resonant frequency ranges. For example, the sensing transducers may include a plurality of cantilever beams with different lengths arranged in one or more rows, each of the transducers corresponding to different resonant frequency ranges. It is further contemplated that the sensing transducers may include multiple transducers in a single axis (e.g., X, Y, or Z), and/or may have different resonant frequency ranges to sense in a range of frequencies. Various resonant frequency ranges may be achieved by changing spring and/or proof mass structures of the sensing transducers as disclosed herein. Thus, multiple X, Y, Z axis transducers can be formed on a single die having various resonant frequency ranges by changing proof mass dimensions and/or beam spring structures for frequency modulation and equalization. Additionally, multiple transducers can be located on the die surface in alternating manners in order to maximize die area. Furthermore, sensing transducers can be duplicated with the same design and dimension in the same axis in order to increase a signal to noise ratio (SNR). In an embodiment, vibration sensing transducers operating in accordance with piezoelectric transduction principles may provide power savings since piezoelectric sensing transducers can be power generators and not require a bias voltage.

In addition, although not specifically disclosed, in accordance with embodiments, a motion sensor may be integrally formed within the MEMS microphone and vibration sensor die. Representatively, the motion sensor may be a Y axis motion sensor formed within and/or on the same substrate as the MEMS microphone and MEMS vibration sensor using the same MEMS processing steps. For example, the motion sensor may include a proof mass, folded springs and sensing comb structures that can be used to detect a motion of the MEMS microphone and vibration sensor die within which it is integrated. In particular, the motion sensor can detect the motion of a user moving the MEMS microphone and vibration sensor die to the neck to detect a vibration of the vocal cords, and this information can then be used to initiate a mechanical vibration detection mode where the vibration sensor is used to detect sound instead of, or in addition to, the MEMS microphone.

In one aspect, the MEMS microphone and vibration sensor packages in accordance with embodiments incorporating multiple sensing transducers may cover a wider frequency range, with a more consistent sensitivity, compared to a traditional microphone such as ECM. Since the vibration sensors may be formed in a batch process, multiple transducers can be formed within a single axis, and across multiple axes on the same die substrate. In an exemplary embodiment, high frequency (e.g., 10 kHz to 20 kHz), middle frequency (e.g., 1 kHz to 10 kHz), and low frequency (e.g., less than or equal to 100 Hz to 1 kHz) may be formed within a single axis. In some embodiments, low frequency sensing transducers may measure a 1 Hz frequency, within a specific sensitivity range. Thus, each sensing transducer can be tuned to have a specific sensitivity to a specific frequency range, thereby spreading a uniform sensitivity across a broad frequency range. Additionally, this may enable sensitivity at frequency ranges that may not previously have been possible with microphones such as ECM.

In one aspect, MEMS vibration sensors incorporating vibration sensing transducer arrangements described herein may be used for outside noise rejection. For example, in additional to vocal cord vibration sensing as previously discussed, the vibration sensing transducers may be tuned to detect bone vibration, such as bone (e.g., jaw bone) vibration of a user's head. Accordingly, outside noise not originating from a user's bone vibration may be rejected.

In one aspect, MEMS microphone and vibration sensor dies, and/or the MEMS vibration sensors, described herein may be used for a variety of diagnostic applications, including motion, voice, and bio signal detection (e.g., heart beat, blood flow, motion, vibration, and other sounds) and machine operation (e.g., car engine, etc.). The MEMS microphone and vibration sensor dies and packages described herein may be incorporated into a variety of devices other than a remote controller, including, but not limited to, mobile telecommunication devices, ear buds, and a belt (e.g., wrist band, watch belt, ankle band, chest and back belt, etc.).

In utilizing the various aspects of the embodiments, it would become apparent to one skilled in the art that combinations or variations of the above embodiments are possible for forming a MEMS microphone and vibration sensor die and package. Although the embodiments have been described in language specific to structural features and/or methodological acts, it is to be understood that the appended claims are not necessarily limited to the specific features or acts described. The specific features and acts disclosed are instead to be understood as embodiments of the claims useful for illustration.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A micro-electro-mechanical systems (MEMS) microphone and vibration sensor die comprising:

a die substrate;

a MEMS microphone on the die substrate; and a MEMS vibration sensor on the die substrate, the MEMS vibration sensor having a plurality of beam transducers, each of the plurality of beam transducers having a beam and a proof mass, wherein each proof mass is tuned to a different resonant frequency range and comprises a same material as the die substrate.

2. The MEMS microphone and vibration sensor die of claim 1 wherein each beam comprises a same length dimension.

3. The MEMS microphone and vibration sensor die of claim 1 wherein at least one proof mass comprises a different length dimension than another proof mass.

4. The MEMS microphone and vibration sensor die of claim 1 wherein the MEMS microphone comprises a diaphragm, and the diaphragm comprises a same material as each beam.

5. The MEMS microphone and vibration sensor die of claim 1 wherein the MEMS vibration sensor is operable to detect mechanical vibrations within a frequency range of from 20 Hz to 20 kHz.

6. The MEMS microphone and vibration sensor die of claim 1 wherein the plurality of beam transducers comprise a first beam transducer and a second beam transducer, wherein the first beam transducer is operable to detect a mechanical vibration in a first frequency range and the second beam transducer is operable to detect a mechanical vibration within a second frequency range, wherein the first frequency range is different than the second frequency range.

7. The MEMS microphone and vibration sensor die of claim 1 wherein the MEMS microphone and the MEMS vibration sensor are integrally formed with the die substrate as one integrally formed unit, and the integrally formed unit is mounted to a package substrate.

8. The MEMS microphone and vibration sensor die of claim 1 wherein the MEMS microphone and vibration sensor die is incorporated into a remote control housing for a headphone.

9. A headphone remote controller having multiple sensors, the headphone remote controller comprising:

a housing for a remote controller of a headphone, the housing having a housing wall defining a vibration contact side for the remote controller;

a multiple sensor package positioned within the housing, the multiple sensor package comprising a micro-electro-mechanical systems (MEMS) microphone, a plurality of MEMS beam transducers having different proof masses corresponding to different resonant frequencies, and an application-specific integrated circuit (ASIC) electrically connected to the MEMS microphone and the MEMS beam transducers;

a printed circuit board (PCB) positioned within the housing, wherein the multiple sensor package is mounted to the PCB; and a capacitive contact sensor mounted to the wall defining the vibration contact side for the remote controller.

10. The headphone remote controller of claim 9 wherein the multiple sensor package is mounted to a side of the PCB facing the vibration contact side for the remote controller.

11. The headphone remote controller of claim 9 wherein the different proof masses are connected to a plurality of beams, and each of the beams have a same length dimension.

12. The headphone remote controller of claim 9 wherein the MEMS microphone and the plurality of beam transducers are integrally formed with a die substrate as a single integrally formed unit, and the single integrally formed unit is mounted to a package substrate.

13. The headphone remote controller of claim 9 wherein the MEMS microphone is connected to a first die substrate and the plurality of beam transducers are connected to a second die substrate, and wherein the first die substrate and the second die substrate are separately mounted to the package substrate.

14. The headphone remote controller of claim 9 wherein the MEMS microphone is operable to sense air pressure changes corresponding to a first frequency range and the plurality of beam transducers are operable to sense mechanical vibrations corresponding to a second frequency range.

15. The headphone remote controller of claim 9 wherein the capacitive contact sensor comprises a pattern of contacts operable to detect a contact between the housing and a user.

16. The headphone remote controller of claim 15 wherein a width of the contact with respect to the pattern of contacts is used to differentiate between a first contact indicating a user is using the remote controller to control the headphone and a second contact indicating the user is sensing a vocal cord vibration through the user's skin.

17. A method of manufacturing a micro-electro-mechanical systems (MEMS) microphone and vibration sensor die, the method comprising:

providing a substrate; and forming a MEMS microphone and a MEMS vibration sensor from the substrate, the MEMS microphone having a diaphragm and a top plate suspended over a first opening in the substrate, and the MEMS vibration sensor having a plurality of beam transducers with different resonant frequencies, each of the plurality of beam transducers having a beam and a proof mass suspended over a second opening in the substrate, and wherein the diaphragm and the beam of each of the plurality of beam transducers is formed from a polysilicon layer formed over the substrate.

18. The method of claim 17 wherein forming comprises:

etching the substrate to form a microphone cavity and a vibration sensor cavity;

depositing a first sacrificial layer within the microphone cavity and the vibration sensor cavity;

depositing the polysilicon layer over the first sacrificial layer; and patterning the polysilicon layer to form the diaphragm of the MEMS microphone and the beam of each of the plurality of beam transducers.

19. The method of claim 18 wherein the proof mass for each of the beam transducers is formed within the vibration sensor cavity during etching.

20. The method of claim 18 wherein the polysilicon layer is a first polysilicon layer, and forming further comprises:

depositing a second sacrificial layer over the diaphragm and the beam;

depositing a second polysilicon layer over the sacrificial layer;

patterning the second polysilicon layer to form a first top plate over the diaphragm and a second top plate over the beam;

etching a back side of the substrate to form the first opening and the second opening; and using the first opening and the second opening, wet etching the first sacrificial layer and the second sacrificial layer to release the diaphragm, the beam and the proof mass.

* * * * *